US005479755A

United States Patent [19]

Pacione

[11] Patent Number: 5,479,755

[45] Date of Patent: Jan. 2, 1996

[54] METHOD OF INSTALLING LOOPED BACKED CARPET

[75] Inventor: Joseph R. Pacione, Thronhill, Canada

[73] Assignee: Tac-Fast Systems SA, Switzerland

[21] Appl. No.: 444,259

[22] Filed: May 18, 1995

Related U.S. Application Data

[63] Continuation of Ser. No. 251,955, Jun. 1, 1994.

[51] Int. Cl.[6] ..... A47G 27/04

[52] U.S. Cl. ..... 52/746.1; 52/DIG. 13

[58] Field of Search ..... 52/746, DIG. 13

[56] References Cited

U.S. PATENT DOCUMENTS 4,822,658 4/1989 Pacione ..... 428/95

FOREIGN PATENT DOCUMENTS 70295248 11/1970 Germany ..... 52/DIG. 13

1546901 5/1979 Germany ..... 52/DIG. 13

*Primary Examiner*—Carl D. Friedman

*Assistant Examiner*—Yvonne Horton-Richardson

*Attorney, Agent, or Firm*—Brian W. Gray

[57] ABSTRACT

A method of installing a looped backed carpet is disclosed in which water is applied to the carpet, the carpet is allowed to expand, and the carpet is then affixed in place by a hook and loop system in its expanded state.

18 Claims, 3 Drawing Sheets

METHOD OF INSTALLING LOOPED BACKED CARPET

FIELD OF THE INVENTION

This application is a continuation of application Ser. No. 251,955, filed Jun. 1, 1994.

This invention relates to a method of installing a looped backed carpet by a hook and loop installation structure.

BACKGROUND OF THE INVENTION

Traditionally, wall to wall carpets have been installed by either being glued to concrete flooring (in commercial installations) or by stretching between staggered rows of steel pins (such as in the Roberts "smooth-edge" form of installation).

In U.S. Pat. No. 4,822,658 dated Apr. 18, 1989, a new system of carpet installation is disclosed in which a carpet is constructed having a backing substantially consisting of loops to be installed by hooked tape attached to the floor by pressure sensitive adhesive.

However even with this system, certain carpet products such as one's manufactured using synthetic nylon fibre can have significant atmospheric dimensional stability problems.

These problems stem from the fact that nylon absorbs moisture at a rate of approximately 6% of its weight and expands at a rate of approximately 30% of its size.

It seems certain manufactured products present more of a problem than others. Many reasons are contributing factors, for example, the type of manufacturing process used and the type of material (latex, C.V.A. Polyurethane etc.) used to encapsulate and tuft lock the bundles of fibre that are tufted through the primary backing. A real problem is that a carpet installer on site is unaware of any impending atmospheric problem until it is too late. Once the carpet has been installed at the perimeter and seams the ability for it to grow at the perimeter is eliminated and any growth will manifest itself in the form of unsightly buckles and wrinkles etc. The growth that occurs is often caused from the atmospheric swings in humidity which can occur. Such swings are most common in buildings which are not climate and temperature controlled.

Attempts to control this buckling have focused on (a) gluing the carpet down along its whole undersurface;

(b) offsetting the expansion of nylon fibre by increasing the weight and rigidity of the carpet by the addition of fibreglass as a stabilizing factor; or (c) using a hook and loop system to attach the carpet across its whole undersurface.

Increased use of fibreglass can give the carpet greater initial dimensional stability but does not entirely solve the problem. In fact in some situations such increased fibreglass can make the buckling worse if the carpet is not rigid enough to withstand the expansion forces. More significantly, increased rigidity makes it much more difficult to manoeuvre, roll, stretch and cut the carpet. It can be very difficult to pattern match such carpets since there is little or no "give" in the carpet by which to adjust the carpet to match the patterns.

SUMMARY OF THE INVENTION

It has now been found, surprisingly, and contrary to currently advocated installation techniques, that carpet can be advantageously installed by a method which first acclimatizes the carpet for possible expansion due to moisture by adding water to the carpet and then fixing the carpet to the floor in its expanded state.

The amount of moisture that is required to expand, for instance, nylon and the time required to wait for the carpet to achieve maximum expansion are such that it is quite feasible to apply water to the carpet during installation without significantly delaying the installation. Further a hook and loop system allows the carpet to be retained in place in its expanded condition after the carpet has dried and would otherwise tend to revert to its contracted state. This allows the carpet to retain its shape, even after drying. Further it has now been found that the carpet does not further expand or buckle even with subsequent cycles of humidity and dryness.

Thus the invention, in one aspect, consists of a method of installing a looped backed carpet comprising the following steps:

(a) installing tape having upwardly facing hooks, onto a floor, the hooks removably covered to prevent premature attachment of the hooks to a carpet.

(b) loose laying a carpet having a loop backing over top of the tape.

(c) applying water to the carpet to allow the carpet fibres to absorb water.

(d) waiting for a period to allow the carpet to achieve substantially maximum expansion.

(e) removing the tape covering to attach the carpet to the floor in its substantially expanded state.

In another more general aspect, the invention consists simply of wetting the carpet to allow it to expand, waiting for it to expand and then installing it onto the floor with a hook and loop system.

In a more specific aspect of the invention, the method consists of installing a looped backed carpet comprising the following steps:

(a) installing tape having upwardly facing hooks onto a floor, the hooks removably covered to prevent premature attachment of the hooks to a carpet.

(b) loose laying carpet having a loop backing over top of the tape.

(c) removing at least some of the tape covering to attach the carpet to the floor.

(d) applying water to the carpet to allow the carpet to absorb water.

(e) waiting for a period to allow the carpet to achieve substantially maximum expansion.

(f) disengaging the carpet from the tape in at least some areas to relieve pressure and buckling created by the carpet expansion.

(g) re-attaching the carpet to the tape in a substantially expanded state.

PREFERRED EMBODIMENT

Figure 1:
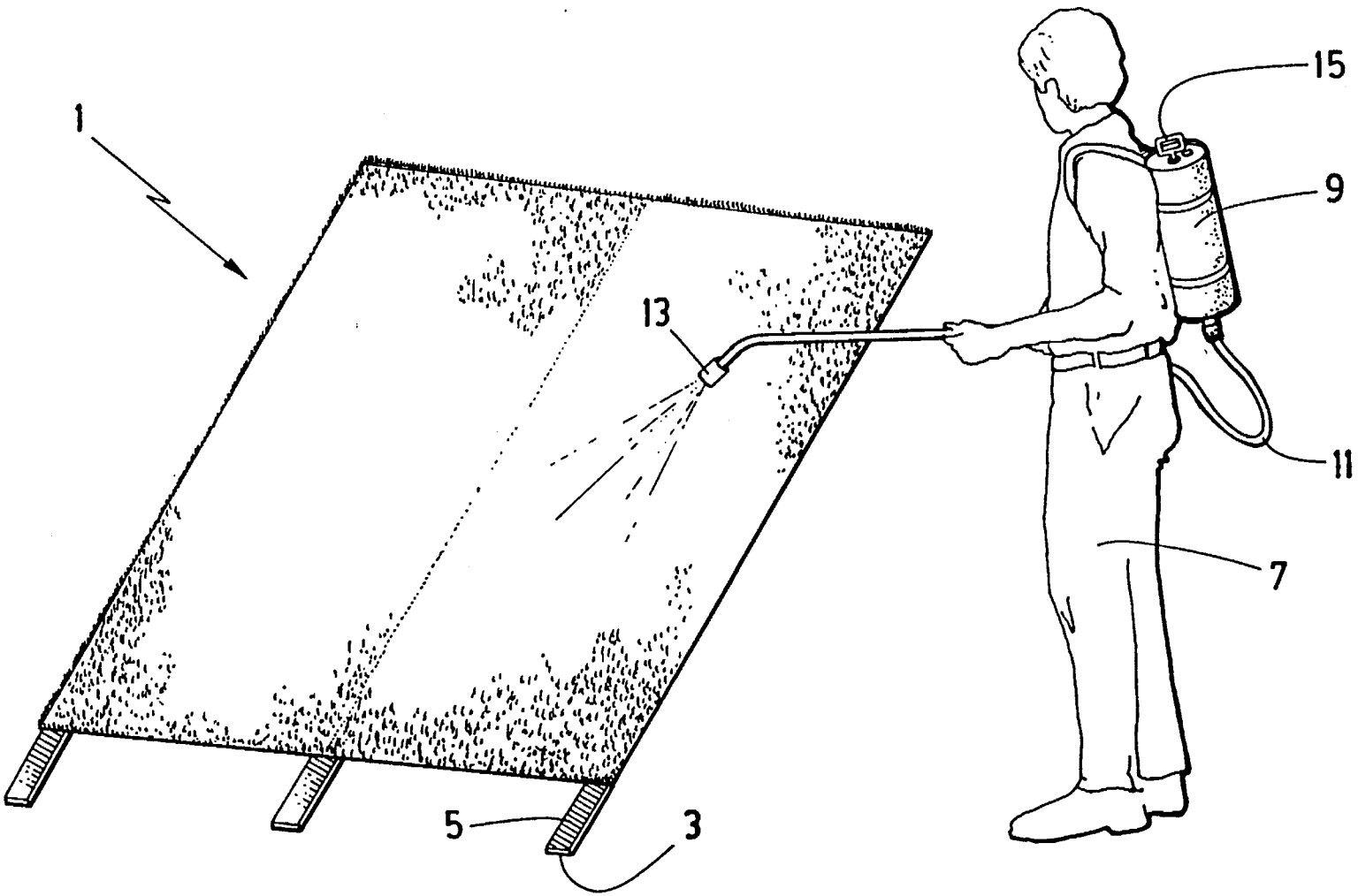
FIG. 1 is a view of a carpet installer spraying a carpet.

In FIG. 1 is shown a carpet 1 loosely installed on a floor overlaying carpet tape 3. The tape initially has a tape covering 5 which prevents attachment of the loops on the back of carpet 1 to the hooks on tape 3 (as shown best in FIG. 2) until the tape covering has been removed. In FIG. 1 carpet installer 7 has a simple pressurized water container 9 having a hose 11 and spray nozzle 13. Such water canisters are typically pressurized by a hand pump 15 on the top of the can and can easily hold one gallon of water. Installer 7 simply passes spraying head 13 across the carpet in a number of passes sufficient to deposit about one gallon of water per one hundred square yards.

In FIG. 1 since carpet 1 is not attached to tape 3, the carpet will simply grow after it has been wet, assuming it is made of an artificial or synthetic material which grows when wet. Nylon is the most common such material, and it will absorb water so as to gain 6% by weight and 30% by size. It has been found that this absorption takes place, in a typical carpet, where the water is applied by spraying on the top surface over a period of approximately four hours.

The water could equally be applied to the back of the carpet (assuming that the carpet does not have a waterproof backing) or immediately to the floor as the carpet is unrolled. Moisture however applied will be readily absorbed by the nylon fibres.

An experiment was done using a nylon carpet from Peerless Carpet, Montreal, Canada. This nylon carpet was sent to Textile Rubber for backing with a thermoset elastomer polyurethane, and it was then laminated with a knit loop backing.

The carpet was attached to a concrete floor at its perimeter by the use of a hooked tape, and was then sprayed with water from a water container from the top as shown in FIG. 1 until water was visible on the pile when the pile was depressed with a finger.

Within one hour there was visible buckling of the carpet. Constrained around its perimeter, the carpet buckled along only one direction. The buckles continued to rise for four hours. Within four hours the carpet achieved maximum expansion or buckling. The buckling stayed in the carpet for approximately two hours and then started to go back down.

Subsequent tests have proven that in most nylon carpets available today, substantially maximum expansion is achieved in four hours. Further, if the carpet is attached equally along its perimeter edges or not attached at all, the expansion usually only occurs in one direction along the machine gage of the carpet. This appears to be the path of least resistance. Thus in carpet strips, the expansion usually occurs along the narrow width of the strip and not along the length.

In subsequent experiments, the carpet was attached to the floor as described in the first experiment above. After the carpet achieved maximum buckling in four hours, the carpet was removed from the tape to relieve the pressure caused by the buckling and then re-attached to the tape. After the carpet dried, it did not pull off of the tape and remained in its acclimatized state, even after repeated wetting and drying cycles.

Further experiments with this acclimatized carpet in a humidity and temperature controlled tent has shown that such carpet does not buckle or move when exposed to cycles of temperature and humidity, even when exposed to 90% humidity for three days.

It will be appreciated that under normal circumstances, carpets are generally in air conditioned, climate controlled environments and that it would be rare for the humidity level in a room to be over 90% for more than three days. This may happen however in the case of an air conditioning breakdown.

Figure 2:
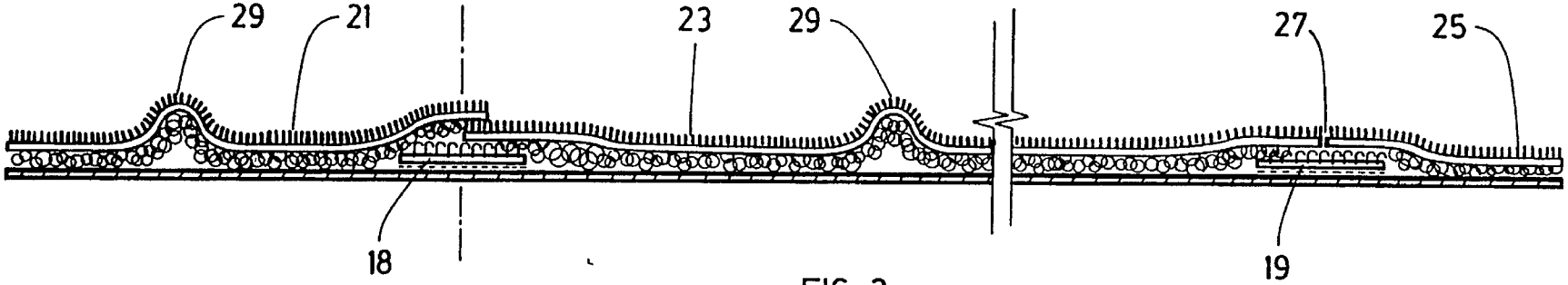
FIG. 2 is a section view showing two overlapped carpet strips after wetting prior to the release of buckling expansion.

The carpet grows primarily in only one direction (typically the width of a roll) along the machine gage. It is thus possible to install the carpet over tapes in anticipation of this growth. If the carpet is attached to the floor first, a visible buckling can be seen after the application of water as an indication that the carpet has grown. Thus as shown in FIG. 2, tapes 18 and 19 are attached to the floor, initially with a covering (not shown). Carpet strips 21, 23 and 25 (or any number of additional carpet strips) are laid over the tapes and tape covering so that the seams meet over the tape.

As it is normally only necessary to re-do every other seam in order to release tension arising from growth in, for instance, carpet piece 23, the seam 27 can be finished between carpet piece 21 and 25. The installer will normally leave a slight overlap at every other seam, for instance, between carpet piece 23 and carpet piece 21. This assures that there is room for the carpet to overlap to create an even seam, even if the carpet does not grow significantly after wetting.

In the normal case, the carpet pieces would be attached at least to the tapes under the longitudinal seams. However carpet piece 21, for instance, would only be partially attached to tape 19 as shown allowing for an overlap.

FIG. 2 shows the arrangement after initial preliminary installation and after the addition of water to the surface of the carpet. Water sprayed on the carpet as shown in FIG. 1 will result normally in buckling 29 along the width of the carpet as shown in FIG. 2. Although the carpet is, of course, narrower in width and in length, the carpet generally expands along the machine gage width along the path of least resistance. It is possible for some expansion to occur in length, but this has not been observed in experiments to date. This, however, could easily be accommodated by the release and reattachment of the carpet at the ends as required.

Figure 3:
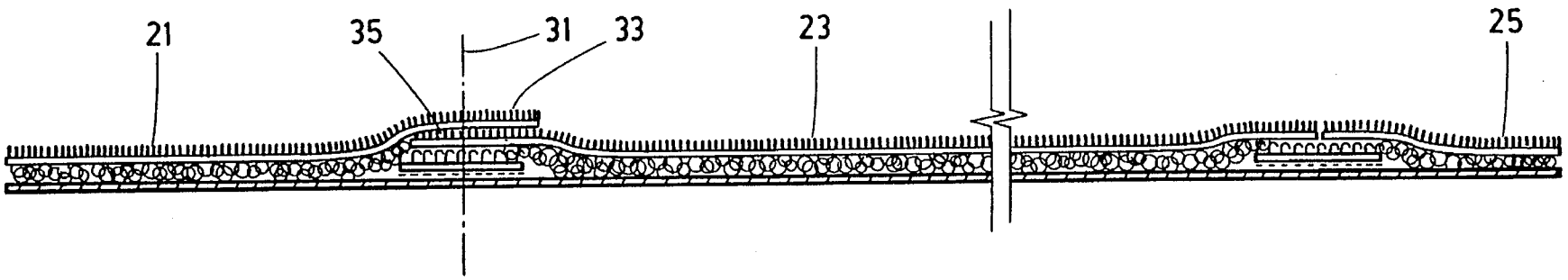
FIG. 3 is a section view showing two overlapped carpet strips after release of buckling expansion and just prior to final cutting.

After the buckles 29 have reached a certain size, in approximately four hours, an experienced installer will have a visual clue that (a) he has sprayed that particular carpet strip and (b) the strip has reached its maximum level of expansion. The installer can then relieve the pressure of the buckling in, for instance, piece 21 and piece 23 by removing the carpet pieces from tape 19 and expanding them so as to eliminate buckles 29. Piece 21 and 23 will thus overlap further on tape 19 as shown in FIG. 3 and the installer can then cut along the top of the tape at 31 as shown in FIG. 3 to create an even seam. The excess pieces 33 and 35 as shown in FIG. 3 can be discarded and an even seam achieved.

This invention is useful for any natural or synthetic fibre used in carpets which grows or expands with the addition of water. Nylon is the most common such synthetic fibre.

In addition, although the invention has been described with a loop back carpet and hooked tapes (the commercially advantageous form of a hook and loop system), it is equally applicable to a loop tape and hooked carpet.

What is claimed is:

1. A method of installing a looped backed carpet comprising the following steps:

(a) installing tape having upwardly facing hooks, onto a floor, the hooks removably covered to prevent premature attachment of the hooks to a carpet.

(b) loose laying a carpet having a loop backing over top of the tape.

(c) applying water to the carpet to allow the carpet fibres to absorb water.

(d) waiting for a period to allow the carpet to achieve substantially maximum expansion.

(e) removing the tape covering to attach the carpet to the floor in its substantially expanded state.

2. A method as set out in claim 1 in which after step (d) the carpet is cut and fit to a room or adjoining carpet pieces while in an expanded state.

3. A method as set out in claim 1 in which step (b) comprises loose laying multiple carpet strips overlapping each other and trimming such pieces together after step (d), while in an expanded state to achieve a smooth joint between such pieces.

4. The method of claim 1 in which the carpet has nylon pile.

5. The method of claim 4 in which the waiting period of step (d) is at least two hours.

6. The method of claim 4 in which the waiting period is at least four hours.

7. The method of claim 6 in which the waiting period is no more than six hours.

8. The method of claim 1 or 7 in which the water is applied as a mist or spray to the top of the carpet.

9. The method of claim 8 in which the water is applied at a rate no less than one gallon per hundred square yards.

10. A method of installing a looped backed carpet comprising the following steps:

(a) installing tape having upwardly facing hooks onto a floor, the hooks removably covered to prevent premature attachment of the hooks to a carpet.

(b) loose laying carpet having a loop backing over top of the tape.

(c) removing at least some of the tape covering to attach the carpet to the floor.

(d) applying water to the carpet to allow the carpet to absorb water.

(e) waiting for a period to allow the carpet to achieve substantially maximum expansion.

(f) disengaging the carpet from the tape in at least some areas to relieve pressure and buckling created by the carpet expansion.

(g) re-attaching the carpet to the tape in its substantially expanded state.

11. The method of claim 10 in which the water is applied as a mist or spray to the top of the carpet.

12. The method of claim 11 in which the water is applied at a rate no less than one gallon per hundred square yards.

13. The method of claim 10 or 12 in which the waiting period is at least three hours and no more than six hours.

14. The method of claim 12 in which the carpet is installed in strips and the tape is installed on the floor generally to align underneath the longitudinal edges of the carpet strips.

15. The method of claim 14 in which at least some of the longitudinal edges of the carpet strips overlap each other and are attached to the floor during step (c) in an overlapped relationship.

16. The method of claim 15 in which only the overlapped pieces are disengaged during step (f) and are then re-installed in an overlapped relationship during step (g) and comprising the additional step (h) in which the join between overlapped pieces is made by cutting both pieces along the overlap to achieve a matched seam and discarding the unused edge pieces.

17. A method of installing a looped backed nylon carpet comprising the following steps:

(a) installing tape having upwardly facing hooks onto a floor, the hooks removably covered to prevent premature attachment of the hooks to a carpet.

(b) loose laying carpet strips having a loop backing over top of the tape and in which at least some strips overlap an adjoining strip along a longitudinal edge of the strip.

(c) removing at least some of the tape covering to attach the carpet strips to the floor substantially along their longitudinal edges.

(d) applying a spray of water to the carpet at a rate of at least one gallon per hundred square yards.

(e) waiting for a period of at least four hours and not more than six hours to allow the carpet to achieve substantially maximum expansion.

(f) disengaging the carpet strips from the tape in at least some areas to relieve the pressure and buckling by the carpet expansion.

(g) re-attaching the carpet strips in a substantially expanded state to the tape, overlapping an adjoining strip.

(h) cutting the longitudinal edges of both carpet strips along the overlap to achieve a smooth join and discarding the cut pieces.

18. A method of installing a carpet having a fibre which expands when wet comprising the steps of:

(a) wetting the carpet (b) waiting for it to expand (c) installing it onto a floor while still in its expanded stated using a hook and loop attachment system.

* * * * *